United States Patent [19]

Rockerath

[11] Patent Number: 4,666,094

[45] Date of Patent: May 19, 1987

[54] BALL WINDING APPARATUS

[75] Inventor: John L. Rockerath, Utica, N.Y.

[73] Assignee: Figgie International Inc., Richmond, Va.

[21] Appl. No.: 779,486

[22] Filed: Sep. 24, 1985

Related U.S. Application Data

[63] Continuation of Ser. No. 579,438, Feb. 13, 1984, abandoned.

[51] Int. Cl.[4] ..... B65H 54/64; B65H 81/00

[52] U.S. Cl. ..... 242/7.02; 156/170; 156/445; 242/3

[58] Field of Search ..... 242/2, 3, 7.02; 156/170, 445, 186; 57/58.3

[56] References Cited

U.S. PATENT DOCUMENTS

| | | | |
|---|---|---|---|
| 397,303 | 2/1889 | Newell | 242/3 |
| 800,076 | 9/1905 | Cochrane et al. | 242/3 |
| 833,335 | 10/1906 | Perry | 242/3 |
| 1,242,885 | 10/1917 | Loomis | 242/3 |
| 1,423,807 | 7/1922 | Loomis | 242/3 |
| 1,846,342 | 2/1932 | Macbeth | 242/3 |
| 2,136,195 | 11/1938 | Oldham | 242/3 |
| 2,465,992 | 4/1949 | Atti | 242/3 |
| 2,681,770 | 6/1954 | McChesney | 242/3 |
| 2,730,859 | 1/1956 | Gatling | 57/58.3 |

*Primary Examiner*—John M. Jillions
*Assistant Examiner*—Joseph J. Hail, III
*Attorney, Agent, or Firm*—Thomas A. Lennox

[57] ABSTRACT

A ball winding apparatus is described for winding string on a core to form the inner baseball including a ball spinning mechanism against which the core is held by a free spinning holding device where the spinning device imparts a wobble pushing the ball from side to side which is augmented by or opposed by transverse air pressure cylinders moving the holder first to one side and then to the other where the forces are balanced such that the ball holder oscillates in position to produce a random wind and a string conveyance system including hollow tubes transporting the string from the coil supply to a tension producing device feeding string to the winding ball.

19 Claims, 8 Drawing Figures

BALL WINDING APPARATUS

BACKGROUND OF THE INVENTION

This application is a continuation of application Ser. No. 579,438, filed Feb. 13, 1984, now abandoned.

The area of this invention is a ball winding apparatus and specifically a device suitable for winding the string on a rubber core to form the inner baseball, later to be covered with hide and sewn in place.

A number of apparatus have been used to wind baseballs. These have generally included a holding device wherein the ball rests in a free spinning concave surface and forced against a knurled surface spinning at a high rate of speed during which a string is fed to the surface of the ball under tension to be wound on the surface to form the ball. This knurled surface has taken the form of a spinning rod or tube which is pressed against a plurality of cores or balls in various stages of wind to spin the balls. Other driving devices include a concave cylinder with a knurled surface of a radius at least as large as the ball to be wound. Movement of the driving and spinning apparatus along the axis of drive and parallel to the axis of spin of the ball has been used to impart a more random winding on the ball. It has been a continuing problem that the winding is not sufficiently random and that "belting" takes place wherein two or more thread loops are wrapped around the ball in the same circumferential path. This belting tends to distort the cylindrical shape or provides soft spots in the ball. Using prior equipment, a fast ball spin tends to cause the ball to lose contact with the driving apparatus causing increased friction and looping of the string causing it to miss the ball Increasing pressure to hold the ball on the driver tends to produce a tight wind and a too heavy ball.

Another problem with prior ball winding apparatus is that during the high speed winding operation, the transverse motion imparted to the winding ball produces oscillations in the equipment so that the high speed takeoff of the string from the spool oscillates back and forth building up substantial kinetic energy which tends to increase during the winding operation. These wave motions of the string during takeoff affect tension on the ball and thus the density of wind. Inconsistent tension produces variances in ball weight. None of the prior art devices provide a suitable solution for the above problems.

A ball winding sequence and in particular the ball winding of a baseball or other like sports balls, usually involves multiple windings on a core, such as a solid rubber ball. The major league baseball involves four separate windings on the core ball with the first three of string and the last thread. This apparatus involves all four windings and the term "core" and the term "ball" are used interchangeably throughout the specification and claims intended to include all stages of the winding process, from the first wind on the core through each separate winding step to the last wind just before a cover is sewn on.

SUMMARY OF THE INVENTION

It is an object of this invention to provide a ball winding apparatus that will provide a purely random winding with few if any strings or threads following the same circumferential path on the ball.

It is an additional object of this invention to provide an apparatus that will allow the balls to be wound at high speed without the tendency to loop the string off the ball surface during movements of the ball while attempting to achieve windings over the entire surface.

It is a further object of this invention to maintain continuous contact with little or no slippage between the spinning ball and the knurled surface imparting spin to the ball, thus reducing friction and increasing control.

A particular object of this invention is to provide windings that yield reproducible and constant results with little variance from ball to ball in weight, compressibility and performance.

An additional object of this invention is to provide a means of controlling the tension on the string as it is drawn off the spool to eliminate inconsistent results due to changes in tension from run to run.

The present invention is an apparatus that allows for controllable oscillation of the point on the spinning ball surface where the string is wound onto the ball. The invention further provides for control of the position of the ball spin through a balanced sequence of movements to avoid overlapping strands along the same circumferential orbit on the surface of the ball to produce replicates within close tolerances.

This invention provides a controlled pattern of winding implemented by a combination of movements of the ball spinning mechanism and the holding device of the ball. A concave cylinder fixed to a spinning power shaft is capable of being adjusted to be slightly eccentric to the spin axis line, referred to herein as the "wobbler". The ball holding device is a concave cup having a free spinning surface allowing the ball to spin freely in continuous contact with this spinning surface in at least one direction. When the ball is wedged between this concave ball holding device and the wobbler, the eccentric movement of the wobbler exerts forces on the ball from side to side inside the cup. As the ball is spun at a high rate of speed, a line of string under tension is fed to a point on the surface producing a winding that moves across the surface of the ball to cover it in a pattern. Without more, this winding has a tendency to produce a "star burst" effect since the movement is regular and a definite pattern ultimately results on the ball with threads following the same circumferential path around the ball, known in the trade as "banding". It is preferred to impose a further random ball movement during the winding step. This is accomplished by movement and oscillation of the ball holding cup. A sequential pattern of force is placed on the ball cup in a direction roughly parallel to the spin axis of the power shaft. The force is applied first on the ball cup in one direction and then in the opposite direction. It is preferred that this force be insufficient to entirely overcome the moment of force imparted by the wobbler against the ball and ultimately against the ball cup. As a result of this insufficient force, preferrably not programmed to exactly match any rotation movement, the combination of the force imparted by the wobbler imparts an oscillation of the ball cup in a random fasion. An important advantage of the sideways motion of the ball cup, even against pressure, is the transference of the wobbling force in that sideways motion, rather than perpendicular to the axis of rotation of the drive shaft. Preferably, the ball cup will at some time reach a stop full distance to the left and sometimes will reach a stop full distance to the right, each for a split second, but will predominantly oscillate somewhere in between. The average position of the ball cup is dependent upon which direction the force is being applied on the ball cup and oscillating to the degree that that force is either being augmented by or opposed by the moment of force imposed by the eccentric wobbler.

An embodiment of the present invention includes a device to feed the string from the spool to the ball being wound including a hollow tube over which the spool of string is placed with the tube extending above the top of the spool, preferrably about the length of the height of the spool with a smooth opening in the upper end of the tube through which the string is drawn off the spool. The first hollow tube preferrably extends downwardly below the spool to a height below the mechanism used to wind the ball. Of course, this downwardly direction need not be vertical but may be at an angle to the side so that passage of the string is around the mechanism to a position proximate to a tension inducing device that applies and retains tension on the string to the ball held between the spinning device and holder device. It is preferred that there be a second length of hollow tube extending generally horizontally from the bottom opening of the first tube to the position proximate to the tension inducing device. At that change in direction, it is preferred that the both ends of the tube open unobstructively so that the string passes into the open and then back into the second tube.

DESCRIPTION OF PREFERRED EMBODIMENTS

Figure 1:
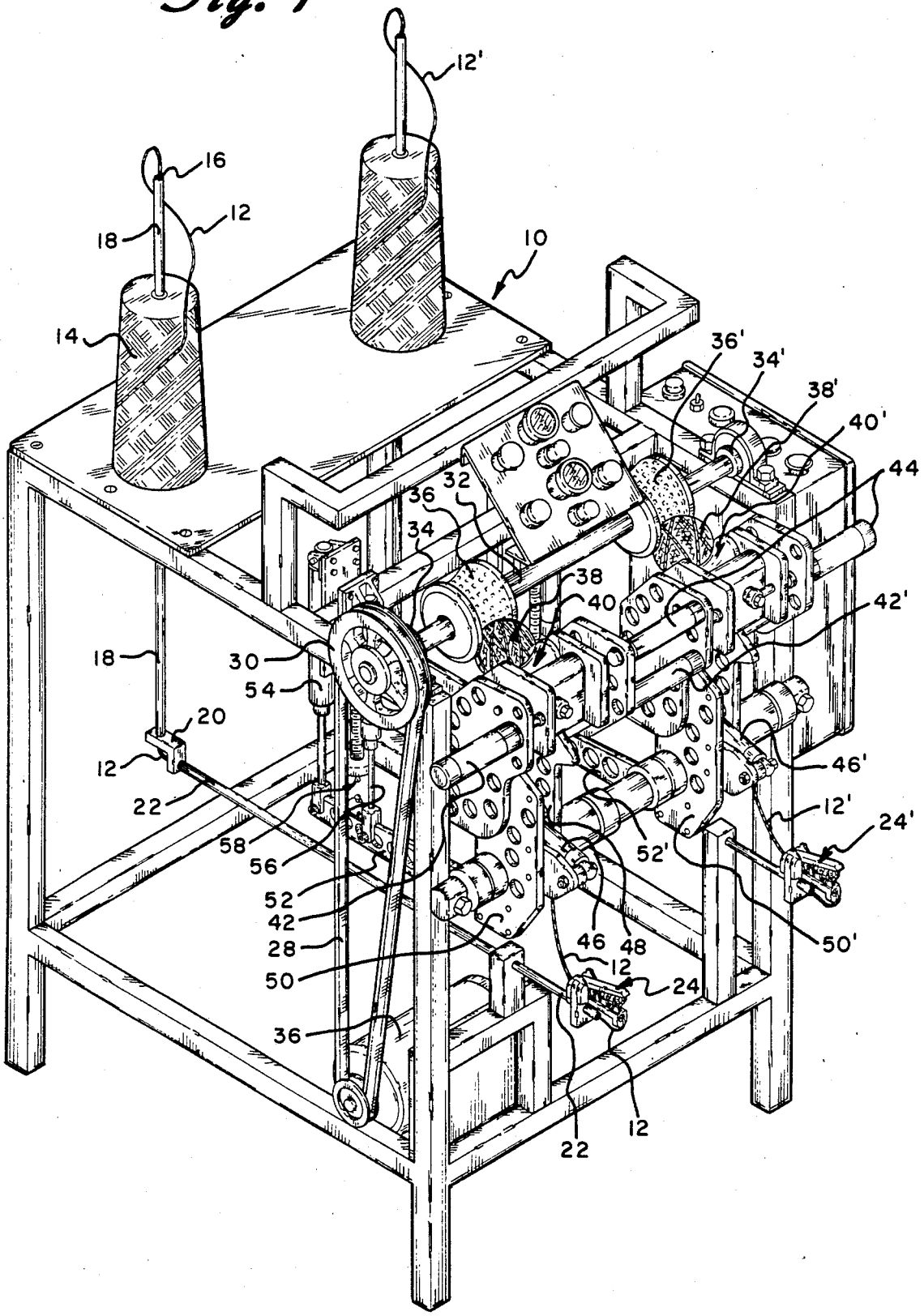
FIG. 1 is a perspective view of a pair of ball winding devices according to this invention.

In FIG. 1, an apparatus according to the invention is illustrated wherein there are essentially two ball winding mechanisms of the present invention installed side by side. The two mechanisms of ball winding machine 10 will be described with the same numbers for like parts with the mechanism on the right side being designated with "primes". String 12 is drawn off spool 14 in an upwardly direction to opening 16 of tube 18 which acts as a holder in the center of the spool. Top opening 16 is rounded and polished so as to allow string 12 to slide over the edge and downwardly through the length of tube 18 to corner bracket 20. Tube 18 passes through a hole in bracket 20 so that string 12 passes through the interior of tube 18 to the open corner of bracket 20. Tube 22 passes through a second hole in bracket 20 and opens to the open corner to receive string 12 which is fed all the way to the end of tube 22 where string is drawn into standard tension device 24 of a type used in most weaving devices to maintain a continuous tension on string 12. String 12 passes from behind the various mechanisms and is hidden until it passes over ball holding device 40 and wound on the surface of ball 38. Motor 26 drives belt 28 to rotate pulley 30 fixed to shaft 32, which spins on bearings 34 and 34' at a high rate of speed. Ball driving wobbling device 36 is rigidly attached on shaft 32, but is purposely not fixed to spin true on shaft 32 but is positioned eccentric on the shaft. Ball 38 is held against wobbler 36 by ball holder device 40. Air cylinder 42 moves ball holder device 40 to the right or left and air cylinder 44 exerts pressure on ball holding device 40 to move it to the left. Ball holder device 40 holds and moves ball 38 against wobbler 36 by the pressure of air cylinder 46, the force being sufficient to hold the ball in position irrespective of growth during the winding process. Arm 48 moves outward against the pressure of increasing ball size. As ball size increases, arm 50 moves with ball holder 40 toward the front of the machine. Horizontal arm 52 rigidly attached to arm 50 moves upwardly as the ball size increases against the pressure of air cylinder 54 and shock absorber 56 until stop mechanism 58 is reached at which time air cylinder 46 is triggered to pull the entire ball holding mechanism 40 away from wobbler 36 for ball removal.

Figure 2:
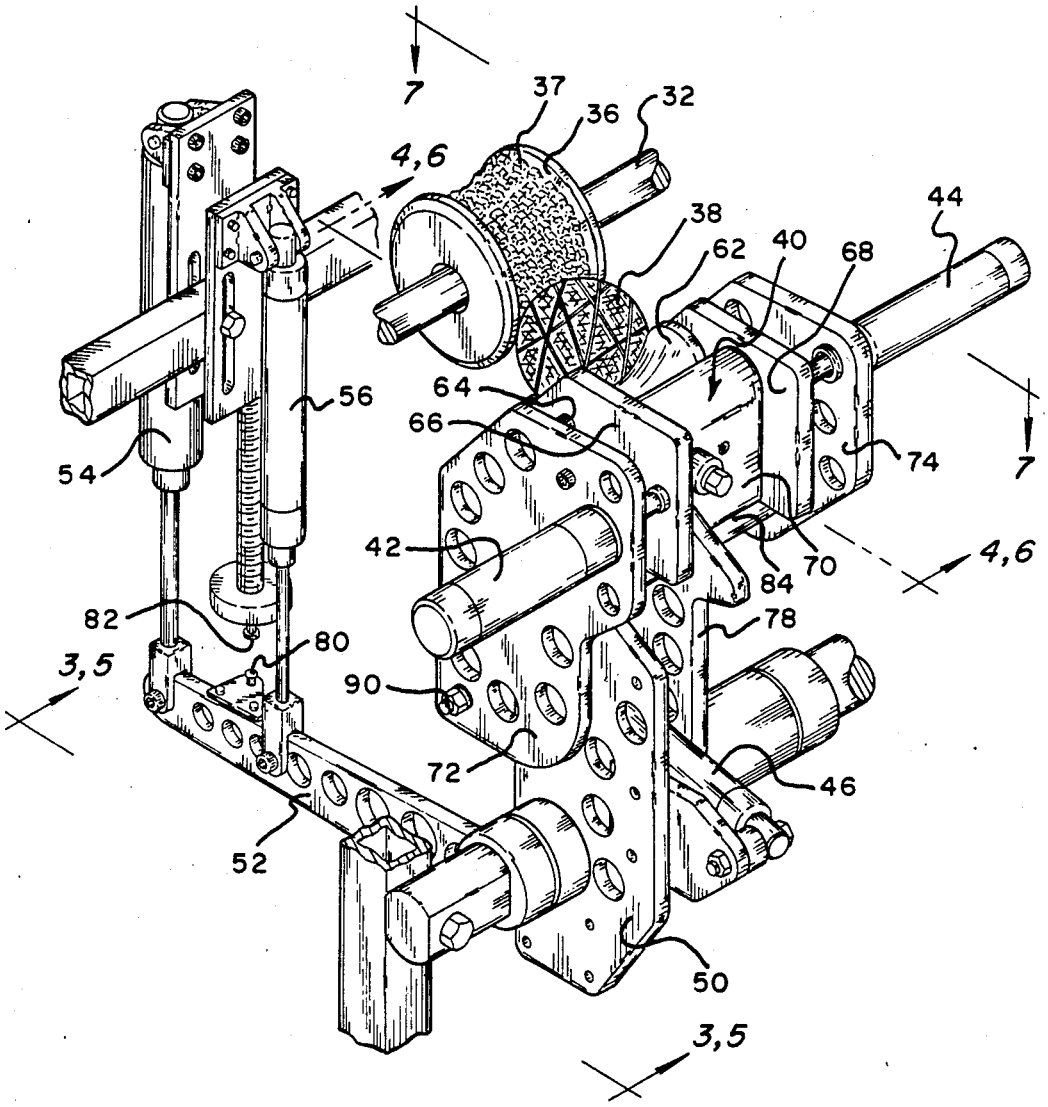
FIG. 2 is an expanded partial perspective view of the device of FIG. 1.

In FIG. 2, an expanded perspective view of the ball winding mechanism illustrated in FIG. 1 shows partially wound ball 38 held against wobbler 36 rotating at a high rate of speed on shaft 32. In this view, part of the ball is hidden by front concave cylinder 62 of ball holder device 40. Polished steel cylinder 62 spins free on end bearings 64 in end brackets 66 and 68. Ball holding device 40 includes base 70 on which brackets 66 and 68 are rigidly attached. Device 40 floats back and forth horizontally on horizontal shafts hidden from view. Air cylinder 44 exerts pressure a distance of about 3/16 inch stroke against bracket 68 to move ball holder device 40 to center position at full out stroke. Two way air cylinder 42 connected to base 70 at connector 71 exerts about one half the pressure of cylinder 44 in either direction to move device 40 against stops 45 or 47. To move ball holder 40 to the right, cylinder 42 exerts force to right while cylinder 44 is off pressure. To force device 40 toward the center, cylinder 44 is on full outstroke and cylinder 42 is directed to pressure right. To move device 40 to the left, cylinder 42 is directed to pressure left while cylinder 44 is out of stroke distance. As will be further illustrated below, the pressures directed by cylinders 42 and 44 on holding device 40 are roughly parallel to the spin axis of shaft 32 and are insufficient to completely override a contrary pressure exerted by wobbler 36 on ball 38 as transmitted to ball holder 40 thus causing device 40 to ride free and oscillate back and forth horizontally. Depending upon the pressures directed by cylinders 42 and 44, the oscillation is more or less controlled and with the higher pressures, the oscillation tends to take place completely within a narrow range of the position directed by the air cylinders. Air cylinder 46 attached to bracket 72 rotates the entire holding mechanism on rod 84 through upright member 78 with a pressure of sufficient pressure to hold ball holding device 40 against ball 38 during the winding process. As ball 38 expands in size during the winding process, arm 50 rotates forward and downwardly moving ball holding device 40 away from wobbler 36 against the pressure of air cyclinder 54, the adjustment of which determines the density of the ball during the winding process. Vibration of horizontal arm 52 is taken up by shock absorber 56 and moves upwardly as ball 38 grows until air switch 80 meets adjustable stop 82, which upon contact triggers air cylinder 46 to drop the entire mechanism including ball holder 40 away from wobbler 36 holding ball 38. A side view pictured in FIG. 3 further illustrates the movement of and control of the mechanism as the ball size grows. Arm 50 rotates on shaft 82 as pressure is increased by the increasing ball size against front concave cylinder 62 and rear concave cylinder 63 which hold the ball against wobbler 36. Cylinders 62 and 63 constitute a ball cup. Arm 52 moves upwardly against the pressure of air cylinder 54 until air switch 80 meets adjustable stop 82 triggering cylinder 46 to an outstroke rotating bracket 72 on rod 84 forward and downwardly to move cylinders 62 and 63 holding ball 38 away from wobbler 36. A cross sectional view taken along lines 4—4 of FIG. 2 illustrates ball holding device 40 in an open position before a ball winding stage. Ball 38 rests on cylinders 62 and 63 spinning freely on shafts 86 and 88 respectively. When device 40 is rotated toward wobbler 36 fixed on spinning shaft 32, ball 38 is spun at a high rate of speed on an axis of spin roughly normal to the surface of the paper. Ball holding device 40 and, in particular, base 70 rides free and oscillates back and forth on rods 90 and 92 as directed by air cylinders 42 and 44, but overridden by peak forces provided by wobbler 36.

Figure 3:
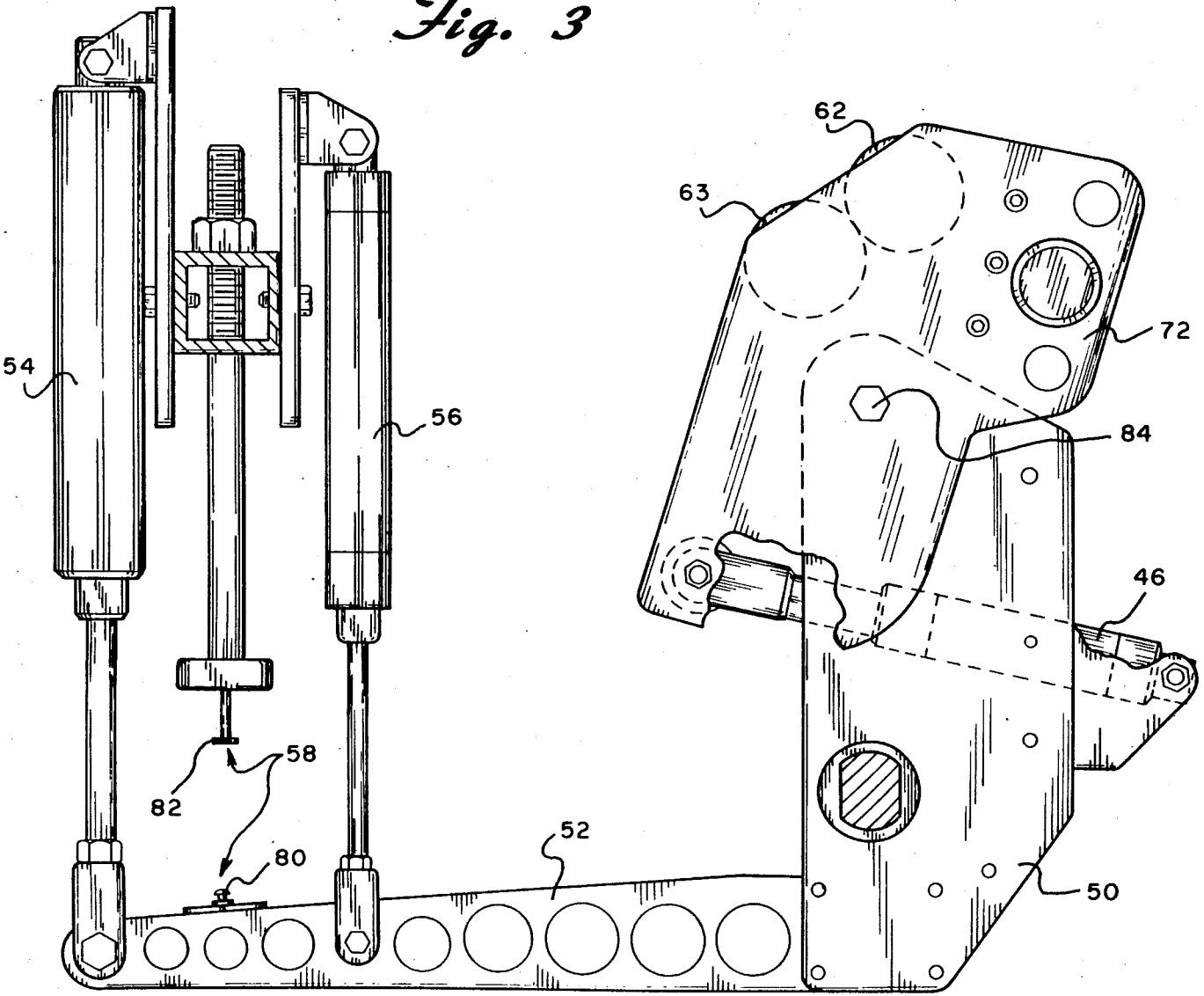
FIG. 3 is a side elevational view taken along lines 3—3 of FIG. 2.
Figure 4:
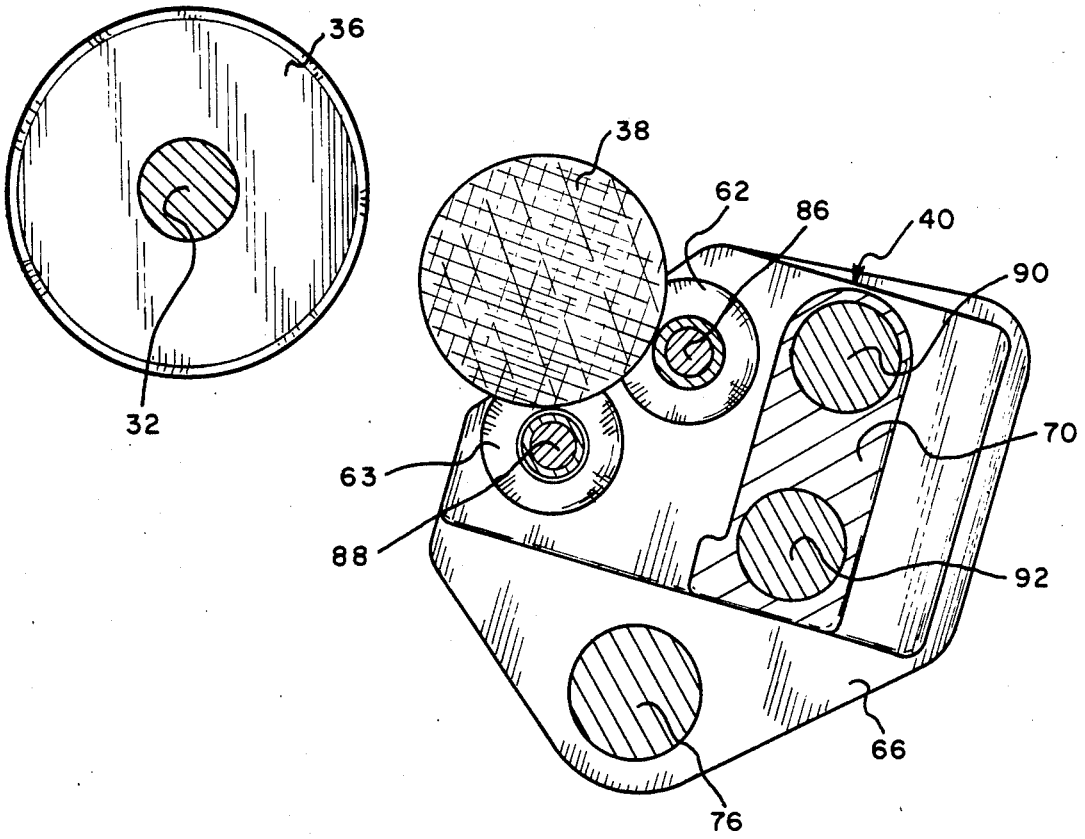
FIG. 4 is a vertical cross-sectional view taken along line 4—4 of FIG. 2.
Figure 5:
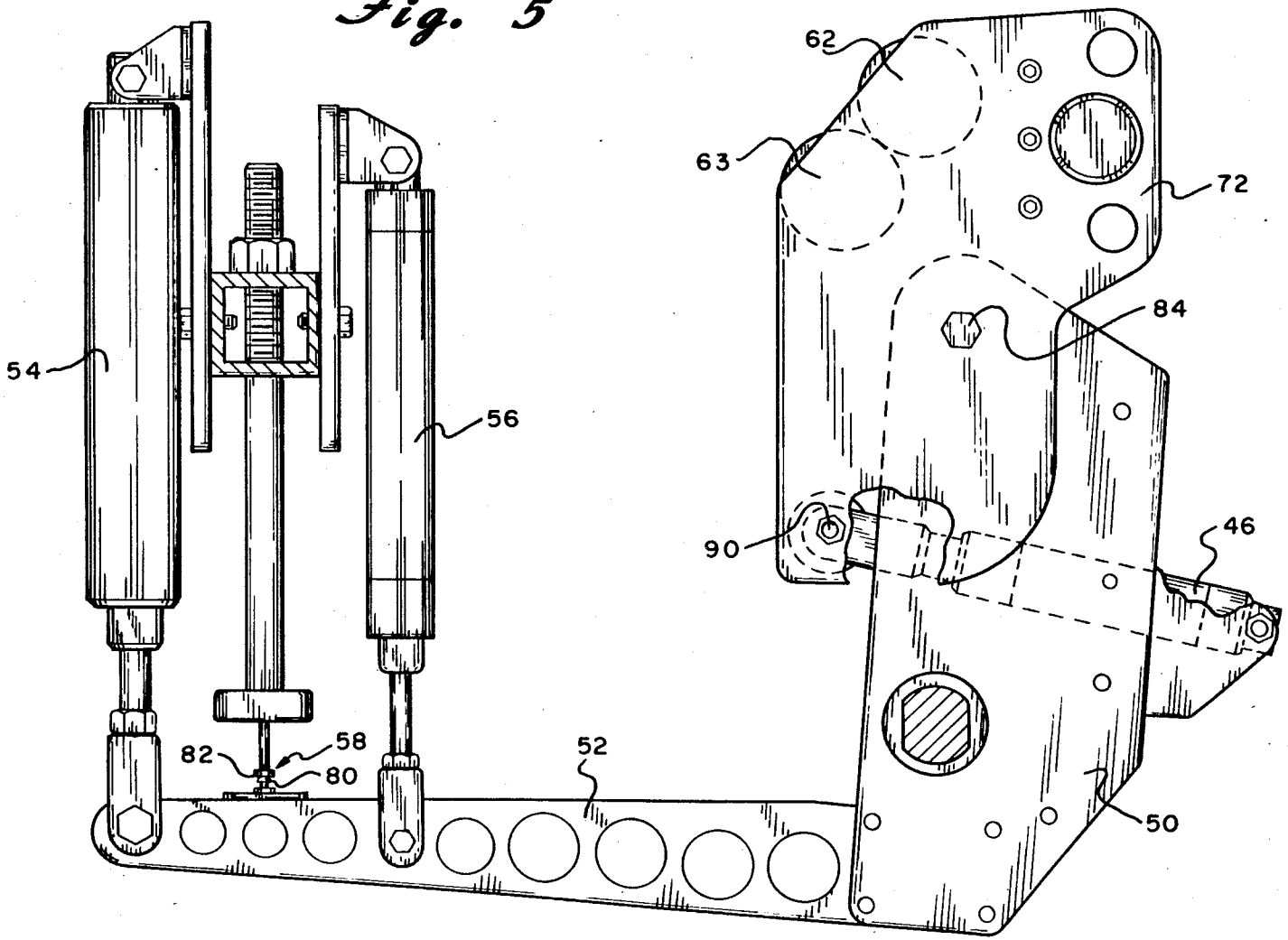
FIG. 5 is a side elevational view taken along lines 5—5 of FIG. 2 with the movement in a different position.

In FIG. 5 the same movement mechanism and holding device illustrated in FIG. 3 is shown in a position where the ball (not shown) has just reached full size. During this particular winding step, cylinders 62 and 63 have been forced forward and downwardly by the expanding ball moving arm 50 forward and downwardly and horizontal arm 52 upwardly until switch 80 has just reached stop 82 against the pressure of cylinder 54. At the instant of viewing, cylinder 46 is signaled to an outstroke pushing backwardly and upwardly on pin 90 connected to bracket 72 to rotate it on rod 84 to move the ball away from wobbler 36 and stop the spin.

Figure 6:
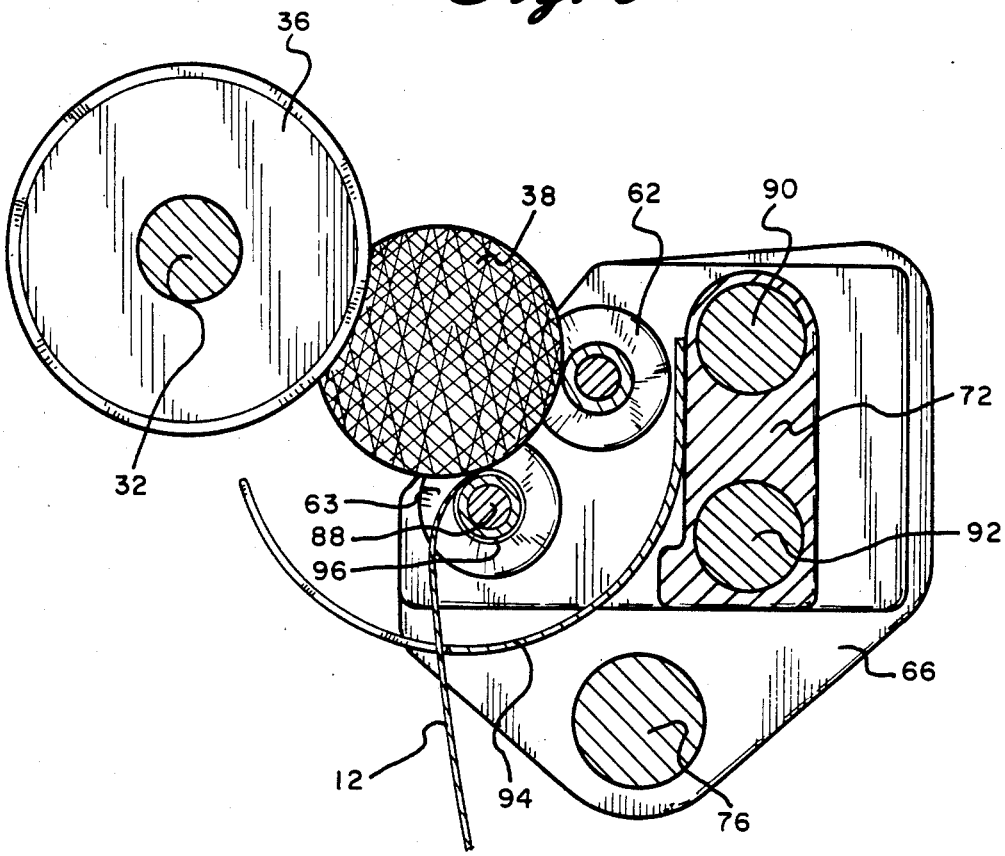
FIG. 6 is cross-sectional view taken along line 6—6 of FIG. 2 with the movement in a different position.

In FIG. 6 a cross-sectional view along lines 6—6 of FIG. 2, illustrates the position of the winding process similar to that illustrated in FIG. 5, wherein ball 38, now close to completion of this winding stage is being spun by wobbler 36 as it rides freely on concave cylinders 62 and 63. String 12 passes through string guide 94 into radial slot 96 around the center in the middle of concave cylinder 63 riding freely on rod 88 at which point string 12 is fed onto and wound directly on ball 38.

Figure 7:
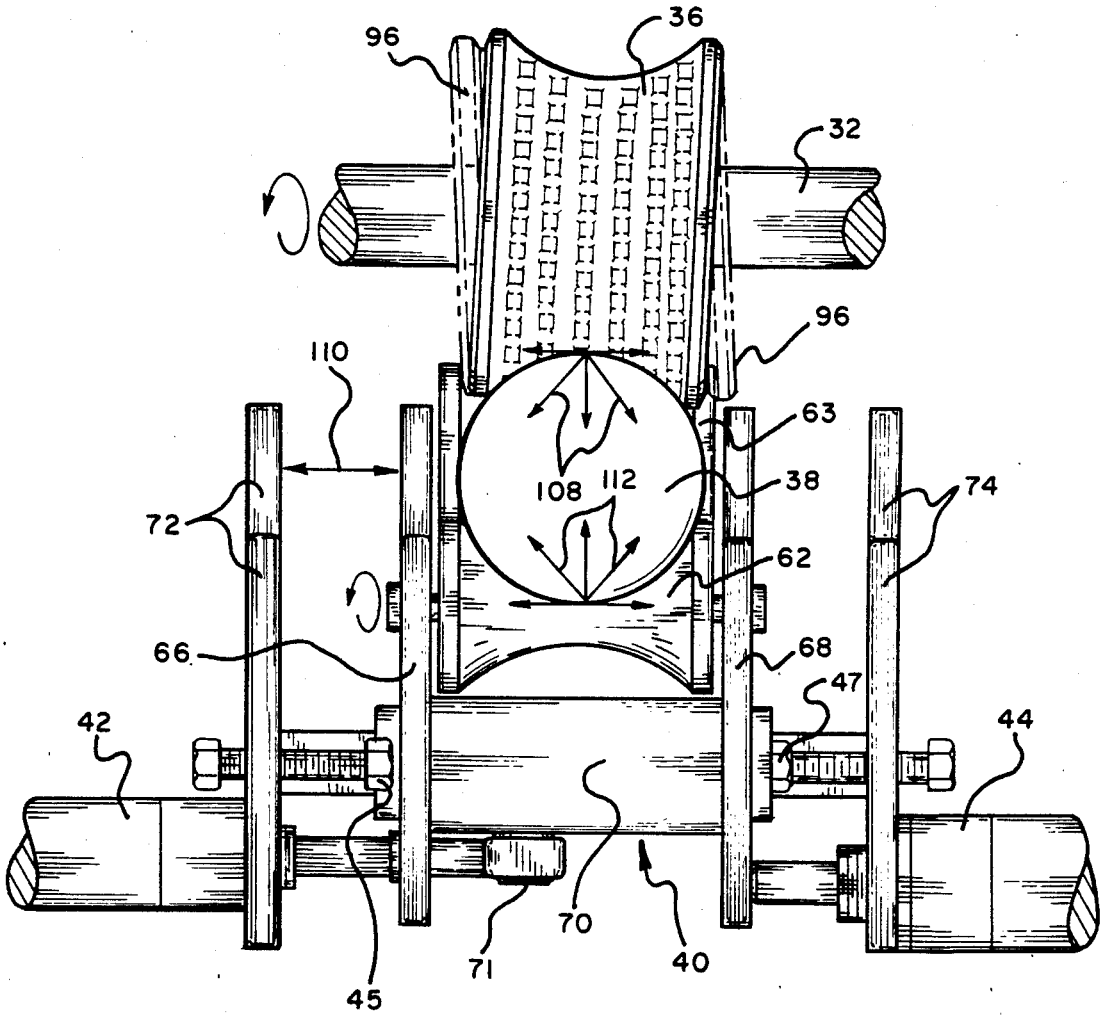
FIG. 7 is a top view of a portion of the device of FIG. 1, taken along lines 7—7 of FIG. 2.
Figure 8:
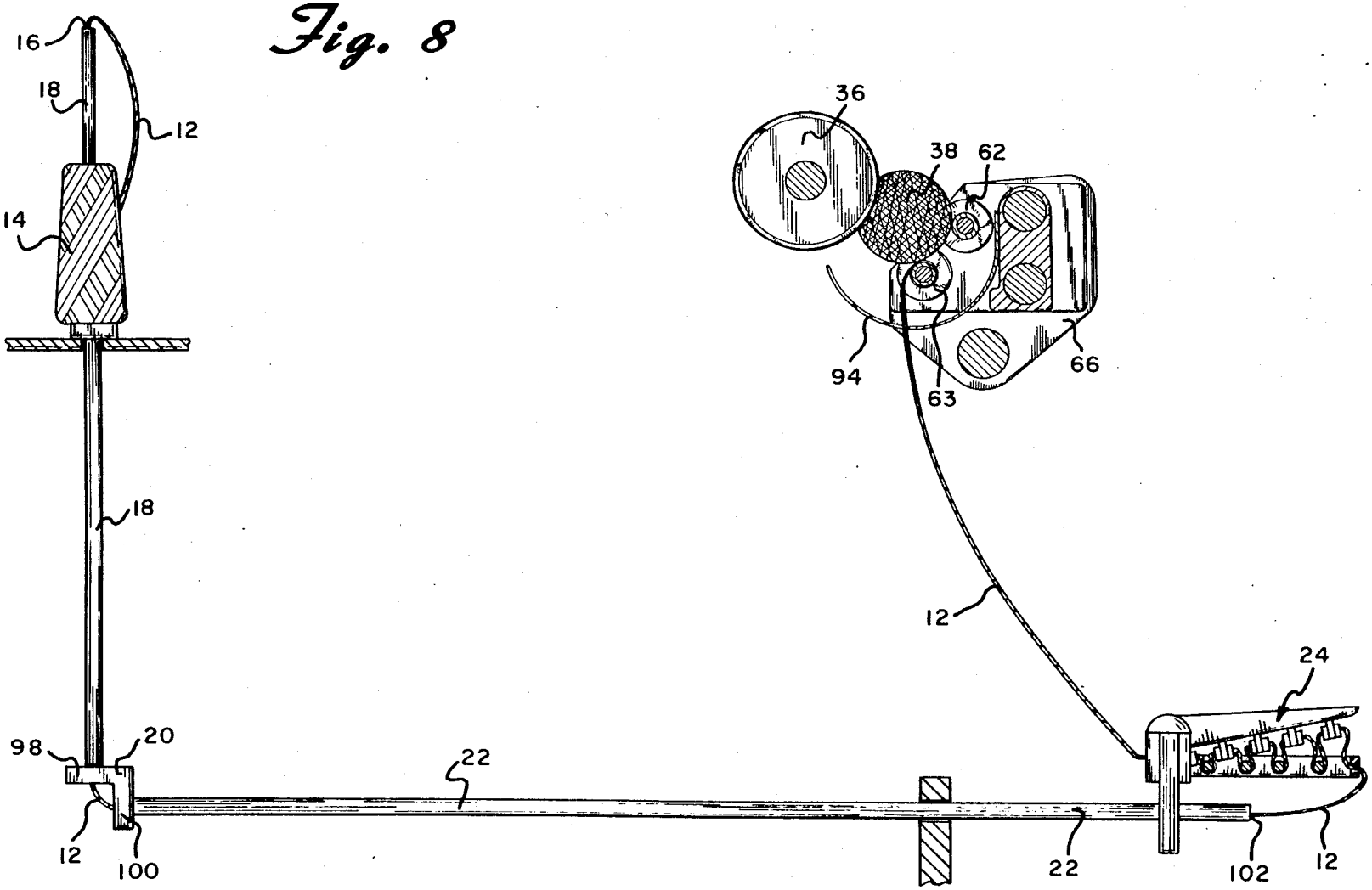
FIG. 8 is a partial side elevational view of the device of FIG. 1 showing the string path.

FIG. 7 is a top view of ball holding apparatus 40 holding ball 38 against wobbler 36 attached rigidly on rotating shaft 32. Wobbler 36 is attached eccentrically to the spin axis of shaft 32 with an offset of about one-half to about five degrees such that when shaft 32 spins, one of the positions of wobbler 36 is illustrated in the shadow view 96 of the left edge. In this wobbling movement, as wobbler 36 moves into position 96, force on ball 38 is not only at the ball center, but has a force moment to the right forcing cylinders 62 and 63 and thus all of ball holder 40 to the right against any pressure that might be being exerted at that time by air cylinder 44 to the left. Since the force exerted by wobbler 36 is essentially unstoppable assuming no slippage of ball 38 there is normally some movement to the right even if cylinders 44 and 42 are on full outstroke to the left. A diagram of force moments is presented to illustrate the various movements and force moments exerted on the ball to change the ball position with respect to the spin axis of shaft 32. Ball 38 is held between wobbler 36 and ball cup cylinder 62. Wobbler 36 is adjustably, but firmly attached to power drive shaft 32 which rotates at a high rate of speed. Wobbler 36 is adjusted to be eccentric on shaft 32 and thus impart a wobbling effect as illustrated by shadow view 96. Force moments 108 are exerted by the eccentric moments on ball 38 as it wobbles first in one direction and then in the other. Force moments 110 are imparted first in one direction and then in the opposite direction by cylinders 42 and 44 on ball cup 62 to impart force moments 112 on ball 38. The movement to left of holder 40 is limitd by adjustable stop 45 and the movement to the right is limited by adjustable stop 47, the total distance between the stops being about $\frac{1}{4}$ inch to about $\frac{3}{4}$ inch. In this embodiment, the eccentric movement of wobbler 36 is irresistable and since most of the force of the wobble can be imparted directly to the ball surface without loss, that force is essentially irresistable. There is, of course, some slippage and loss of force as the ball will tend to move rather than receive and carry all of the force moments to device 40. In this embodiment force moments 110 are not irresistable, being imparted by air cylinders of limited force. It is preferred that the force moments 110 and the force moments 108 imparted by the wobble not be synchronized. Thus, when force 110 is placed on ball cup 62 to move it to the left, it will tend to move it to the left. However, while the position of the ball cup will, in the main, be to the left, the force moments 108 imparted by wobbler 36 when forcing the ball to the right will tend to override the movement to the left. Thus, ball cup 62 will tend to oscillate back and forth with the resultant random movement of ball 38. Force moments 108 imparted from wobbler 36 first in one direction and then in the opposite direction along a line essentially parallel to spin axis of shaft 32 are opposed or augmented by force moments 112 imparted through ball cup 62 along a second direction essentially parallel to the spin axis of shaft 32 on the opposite side of the ball. Essentially random movement side to side of the spinning ball results. FIG. 8 illustrates the full path of string 12 from spool 14 upwardly into top opening 60 in vertical tube 18 which passes down through the middle of spool 14 acting as a holder downwardly to a position below the winding mechanism tube and through upper arm 98 of bracket 20 opening through that arm to allow string 12 to be free of the tubes and allow easy threading of string 12 through the carrying tubes. Horizontal tube 22 connects to lower end 100 of bracket 20 again opening to the corner so that string 12 can feed the entire horizontal length of 22 to end 102 where it is fed through standard tensioning device 24. String 12 is then strung under tension over string guide 94 onto that concave cylinder 63 and wound directly on ball 38.

It is preferred that the ball holding device include two concave cylinders spaced apart in parallel relationship with each cylinder free spinning on a longitudinal axis roughly parallel to the axis of rotation of the ball driving wobbling device, so that the winding ball rests on and between the cylinders. It is further preferred that the ball driving wobbling device include a concave cylinder with the concave surface being of a diameter larger than the ball to be wound and having a gripping surface of truncated pyramids 37, it being a surface to grip the surface of the winding ball. It is preferred that the ball driving wobbling device be attached eccentrically on the power driving axle to cause the device to wobble during rotation and impart a force moment on the winding ball back and forth on a line roughly parallel to the axis of axle spin. The degree of eccentricity is sufficient to cause the ball to move from side to side to move the wind across the surface of the ball and more preferrably sufficient to move the ball holding device side to side and achieve a truly random wind. It is preferred that air cylinders be used to force the ball holding device first in one direction to a stop and then toward the center and then towards the right to a stop, all for approximately equal periods of time and continuing.

While this invention has been described with reference to the specific embodiments disclosed herein, it is not confined to the details set forth and the patent is intended to include modifications and changes which may come within and extend from the following claims.

I claim:

1. A ball winding apparatus to wind string on a core comprising:

(a) a ball holding means to hold the winding ball and allow the ball to spin freely in a concave surface, (b) a ball driving wobbling means to pressure contact the ball surface, spin the ball at a high rate of speed and impart a force moment on the ball in a direction roughly parallel to the axis of rotation of the ball driving wobbling means, and (c) a transverse oscillating means comprising two air cylinders in combination to pressure the ball holding means to move it back and forth along a path parallel to the axis of rotation, first in one direction and then in the opposite direction, wherein the pressure of the transverse oscillating means is insufficient to entirely overcome opposite pressure on the ball from the force of the ball driving wobbling means causing an oscillation of the ball holding means back and forth in a line parallel to the axis of rotation.

2. The ball winding apparatus of claim 1 wherein the ball holding means comprises two concave cylinders spaced apart in parallel relationship, with each cylinder free spinning on a longitudinal axis, wherein the winding ball rests on and between the cylinders.

3. The ball winding apparatus of claim 1 wherein the ball driving wobbling means comprises a concave cylinder with the concave surface being of a diameter larger than the ball to be wound and having a gripping surface means to grip the surface of the ball.

4. The ball winding apparatus of claim 1 wherein the ball driving wobbling means is attached eccentrically on a power driving axle to cause it to wobble during rotation and impart the force moment on the winding ball in a direction parallel to the axis of axis spin.

5. The ball winding apparatus of claim 1 wherein the ball driving wobbling means is attached eccentrically at an angle sufficient to cause the ball holding means to move side to side and achieve a random wind.

6. The ball winding apparatus of claim 1 wherein the air cylinders force the ball holding means first towards the left, then to the center and then to the right for approximately equal periods of time.

7. The ball winding apparatus of claim 1 wherein string is fed to the ball from a spool, the improvement comprising:

(a) a hollow tube over which the spool is placed, the tube extending above the top of the spool, (b) a smooth opening in upper end of the tube through which the string is drawn off the spool, and (c) a length of the tube extending downwardly below the spool to to a position proximate to a tension inducing means that applies and retains tension on the string to the ball held between the spinning means and the holder means.

8. The ball winding apparatus of claim 1 wherein string is fed to the ball from a spool, the improvement comprising:

(a) a first hollow tube over which the spool is placed, the tube extending above the top of the spool, (b) a smooth opening in upper end of the first tube through which the string is drawn off the spool, (c) a length of the first tube extending downwardly below the spool to a height below the spinning means and holder means mechanisms, and (d) a second length of hollow tube extending to a position proximate to a tension inducing means that applies and retains tension on the string to the ball held between the spinning means and the holder means.

9. The apparatus of claim 8 wherein the lower end of first tube opens unobstructively, and the nearby end of the second tube also opens unobstructively and wherein the string may pass unimpeded out of one opening into the open and into the other opening.

10. A ball winding apparatus, wherein a ball is held between a rotating spinning means to impart spin to the ball and a concave ball holder means that holds the ball against the spinning means and spins free in contact with the ball surface, the improvement comprising:

(a) a first force moment means imparting a force moment from the rotating spinning means on the ball first in one direction and then in the opposite direction along a line essentially parallel to the spin axis of the rotating spinning means, and (b) a second force moment means comprising a pair of air cylinders imparting a force moment to the holder means and on the ball, first in one direction and then in the opposite direction, along a second line essentially parallel to the spin axis of the rotating spinning means.

11. The ball winding apparatus of claim 10 wherein the first force moment is essentially irresistable with the distance of point of application of the force moment being variable and limited.

12. The ball winding apparatus of claim 10 wherein the second force moment is insufficient to fully resist any opposing first force moment with complete transfer of force through the ball.

13. A method of winding string on a core comprising:

(a) placing ball core on a ball holding means having a concave surface to hold the ball core as string is wound on it to form a ball, (b) causing the ball holding means to spin freely as the ball is spun against it, (c) spinning the ball at a high rate of speed by pressure contact on the ball surface, (d) imparting a force moment through the pressure contact in a direction roughly parallel to the axis of spinning applied to the ball, (e) pressuring the ball holding means with a pair of air cylinders to move it back and forth along a path parallel to the axis of spinning applied to the ball, and (f) feeding a continuous length of string to the spinning ball, wherein the pressuring of the ball holding means is insufficient to entirely overcome opposite pressure on the ball from the force moment.

14. The method of claim 13 wherein the ball holding means comprises two free spinning concave cylinders spaced apart in parallel relationship.

15. The method of claim 13 wherein the spinning of the ball uses a concave cylinder with the concave surface of a diameter larger than the ball having a gripping surface means to grip the surface of the ball.

16. The method of claim 15 wherein the concave cylinder is attached eccentrically on a power driving axle to cause the cylinder to wobble and to impart the force moment to the ball.

17. The method of claim 13 wherein the force moment is sufficient to cause the ball holding means to move side to side parallel to the axis of spinning applied to the ball.

18. The method of claim 13 wherein the pressuring of the ball holding means is first towards the left, then to the center, and then to the right for approximately equal periods of time.

19. The method of claim 13 which further comprises:

(a) placing a spool of a continuous length of string over a vertical hollow tube extending above the top of the spool, (b) feeding the string into the top end of the tube, (c) pulling the string out the bottom end of the tube, and (d) pulling the string over a tension inducing means that applies and retains tension on the string to the ball being spun.

* * * * *